US010890000B2

(12) United States Patent
Fife et al.

(10) Patent No.: US 10,890,000 B2
(45) Date of Patent: Jan. 12, 2021

(54) FLOOR OPENING SAFETY SYSTEM

(71) Applicant: The Boeing Company, Chicago, IL (US)

(72) Inventors: Matthew E. Fife, Everett, WA (US); Ryan W. Throckmorton, Seattle, WA (US); Harpreet Ghuman, Bothell, WA (US); Kevin R. Krostag, Seattle, WA (US)

(73) Assignee: The Boeing Company, Chicago, IL (US)

( * ) Notice: Subject to any disclaimer, the term of this patent is extended or adjusted under 35 U.S.C. 154(b) by 120 days.

(21) Appl. No.: 16/352,343

(22) Filed: Mar. 13, 2019

(65) Prior Publication Data

US 2020/0291665 A1 Sep. 17, 2020

(51) Int. Cl.
*E04G 5/08* (2006.01)
*E04G 5/00* (2006.01)

(52) U.S. Cl.
CPC ..... *E04G 5/001* (2013.01); *E04G 5/08* (2013.01)

(58) Field of Classification Search
CPC ..... E04G 5/001; E04G 5/08
See application file for complete search history.

(56) References Cited

U.S. PATENT DOCUMENTS 2,797,860 A * 7/1957 Foster ..... A47G 29/121 232/35
4,905,892 A * 3/1990 Fischer ..... A47G 29/1209 232/17
5,595,341 A * 1/1997 Robinson ..... A47G 29/1209 232/17
5,954,264 A * 9/1999 Keller ..... A47G 29/1212 232/17
6,553,929 B1 * 4/2003 Harp ..... G09F 17/00 116/173
7,584,823 B2 * 9/2009 Guering ..... B64D 11/00 182/97
2019/0328165 A1 * 10/2019 Cirri ..... A63J 21/00

* cited by examiner

*Primary Examiner* — Alvin C Chin-Shue
(74) *Attorney, Agent, or Firm* — Joseph M. Rolnicki; Evans & Dixon, L.L.C.

(57) ABSTRACT

A safety system alerts individuals to the presence of a floor opening in a floor grid or work platform decking that is supporting the individuals. The safety system is a passive safety system that is operatively connected to a stationary first floor panel that is adjacent a second floor panel. The safety system is automatically operated to deploy a signal flag above the first floor panel (and activate an audio warning signal) when the second floor panel is removed, exposing a floor opening adjacent the first floor panel. The deployed signal flag alerts individuals on the floor grid or work platform decking to the presence of the floor opening.

20 Claims, 5 Drawing Sheets

FLOOR OPENING SAFETY SYSTEM

FIELD

This disclosure pertains to a safety system that alerts individuals to the presence of a floor opening in a floor grid or work platform decking that is supporting the individuals. In particular, this disclosure pertains to a passive safety system that is operatively connected to a stationary first floor panel that is adjacent a second floor panel. The safety system is automatically operated to deploy a signal flag above the first floor panel when the second floor panel is removed, exposing a floor opening adjacent the first floor panel. The deployed signal flag alerts individuals on the floor grid or work platform decking to the presence of the floor opening.

BACKGROUND

In many manufacturing environments, temporary floor grids or work platform decking are assembled to provide a support surface for individuals working in the area of the floor grid or work platform decking. For example, in the manufacturing of aircraft, it is often necessary to assemble temporary floor grids or work platform decking in the interior of the aircraft or the exterior of the aircraft to support one or more individuals at locations of the aircraft where work is being performed. The floor grids or platform decking are temporary, and are removed when the work in the particular area of the aircraft is completed.

When a floor grid or platform decking is assembled in the interior of the aircraft or the exterior of the aircraft, it at times is necessary to remove a floor panel of the floor grid or platform decking to gain access to a portion of the aircraft beneath the removed floor panel. For example, in a floor grid or platform decking that is comprised of at least a first floor panel and an adjacent second floor panel, it may become necessary to remove the second floor panel and expose a floor opening adjacent the first floor panel to gain access to an area below the floor opening.

Removing the second floor panel and exposing the floor opening adjacent the first floor panel creates a dangerous environment for the individual or individuals working on the first floor panel adjacent the floor opening. The floor opening presents a significant risk to individuals supported on the floor grids or platform decking of falling through the floor opening.

In a standard method of alerting individuals working on a floor grid or platform decking to the presence of a floor opening, orange cones are used to alert the individuals to the presence of the floor opening. When the floor opening is created by removing a second floor panel from adjacent a first floor panel in the floor grid or platform decking, the orange cones are manually positioned around the floor opening to alert individuals to the presence of the floor opening. However, this method of alerting individuals to the presence of a floor opening in the floor grid or platform decking requires that the orange cones be manually positioned around the floor opening immediately after the floor opening is created by the removal of the second floor panel. It is not always possible to have access to orange cones immediately after the floor opening is created, and it is not always possible to immediately manually position orange cones around a floor opening after the floor opening is created. This results in the creation of a risk of an individual falling through the floor opening for some period of time after the floor opening is created until the orange cones can be manually obtained and positioned around the floor opening.

SUMMARY

The floor opening safety system of this disclosure eliminates the period of time that a risk exists to individuals working on a floor grid or work platform decking due to the creation of a floor opening adjacent a first floor panel when a second panel of the floor grid or platform decking is removed, exposing a floor opening adjacent to the first floor panel of the floor grid or platform decking.

The floor opening safety system is comprised of a flagpole that has a distal end and a proximal end. A signal flag is on the distal end of the flagpole.

There is a pivot connection on the flagpole between the distal end of the flagpole and the proximal end of the flagpole. The pivot connection operatively connects the flagpole to a first floor panel that is adjacent a floor opening that has been created by the removal of a second floor panel from over the floor opening.

The flagpole is rotatable about the pivot connection between a first position of the flagpole relative to the first floor panel where the flagpole is oriented horizontally relative to the first floor panel, and a second position of the flagpole relative to the first floor panel where the flagpole is oriented vertically relative to the first floor panel and the distal end of the flagpole and the signal flag are positioned above the first floor panel.

A contact pad is positioned adjacent the first floor panel. The contact pad is configured to contact a second floor panel that is positioned over the floor opening adjacent the first floor panel.

A spring is operatively connected between the contact pad and the first floor panel. The spring biases the contact pad to move away from the first floor panel from a first position of the contact pad where the contact pad is adjacent the first floor panel, to a second position of the contact pad where the contact pad is spaced away from the first floor panel.

A drive lever extends from the contact pad. The drive lever is positioned adjacent the proximal end of the flagpole. The drive lever is movable with the contact pad between first and second positions of the drive lever relative to the first floor panel where in the first position of the drive lever the drive lever is spaced from the proximal end of the flagpole enabling the flagpole to be rotated to the first position of the flagpole relative to the first floor panel, and in the second position of the drive lever the drive lever is in engagement with the proximal end of the flagpole and holds the flagpole in the second position of the flagpole relative to the first floor panel.

When the second floor panel is positioned over the floor opening and is moved toward the first floor panel, the second floor panel engages the contact pad and moves the contact pad from its second position toward its first position relative to the first floor panel. This movement of the contact pad compresses the spring and moves the drive lever from its second position relative to the first floor panel to its first position relative to the first floor panel. This causes the drive lever to disengage from the proximal end of the flagpole. With the drive lever disengaged from the proximal end of the flagpole, the weight of the distal end of the flagpole causes the flagpole to be rotated about the pivot connection to the first position of the flagpole where the flagpole is positioned horizontally relative to the first floor panel.

A cover panel is connected to the first floor panel. The cover panel extends from the first floor panel over the floor opening. The cover panel extends over the contact pad, the spring operatively connecting the contact pad to the first floor panel, the drive lever projecting from the contact pad and the proximal end of the flagpole.

There is an elongate notch provided in the cover panel. The notch in the cover panel extends over the pivot connection and the distal end of the flagpole. The notch provides clearance to the distal end of the flagpole to enable the distal end of the flagpole and the signal flag to rotate upwardly about the pivot connection and through the notch to the second position of the flagpole relative to the first floor panel.

When the second floor panel is removed from its position adjacent the first floor panel exposing the floor opening, the spring biasing the contact pad away from the first floor panel moves the contact pad from its first position adjacent the first floor panel to its second position spaced from the first floor panel. This movement of the contact pad moves the drive lever from its first position relative to the first floor panel to its second position relative to the first floor panel where the drive lever engages against the proximal end of the flagpole. The engagement of the drive lever against the proximal end of the flagpole pushes the proximal end of the flagpole to rotate downwardly, causing the distal end of the flagpole to rotate upwardly through the notch to the second position of the flagpole relative to the first floor panel. This positions the distal end of the flagpole above the first floor panel where the distal end of the flagpole and the signal flag on the distal end of the flagpole provide a visual indication of the floor opening adjacent the first floor panel.

An audio module is operatively connected to the contact pad and/or the spring. The audio module is operable to emit a sound signal in response to the contact pad moving from the first position of the contact pad to the second position of the contact pad. Thus, when the second floor panel is removed from over the floor opening, the audio module is operated to emit a sound signal that warns individuals in the area of the first floor panel of the floor opening adjacent the first floor panel. When the second floor panel is positioned over the floor opening and moved toward the first floor panel, the second floor panel engages against the contact pad and moves the contact pad toward its first position relative to the first floor panel, compressing the spring. This movement of the contact pad and/or the spring operates the audio module to not emit the sound signal in response to the contact pad being in the first position of the contact pad relative to the first floor panel.

The features, functions, and advantages that have been discussed can be achieved independently in various embodiments or may be combined in yet other embodiments, further details of which can be seen with reference to the following description and drawings.

DETAILED DESCRIPTION

Figure 1:
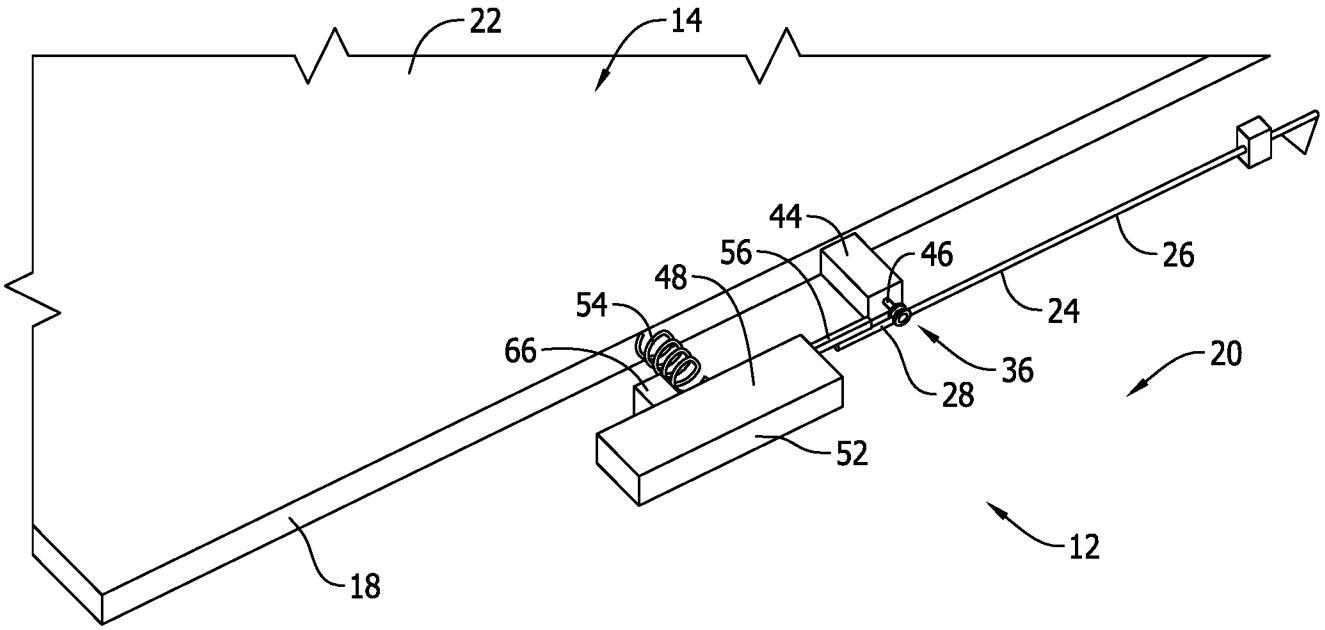
FIG. 1 is a representation of a perspective view of the floor opening safety system of this disclosure operatively connected to a first floor panel.
Figure 2:
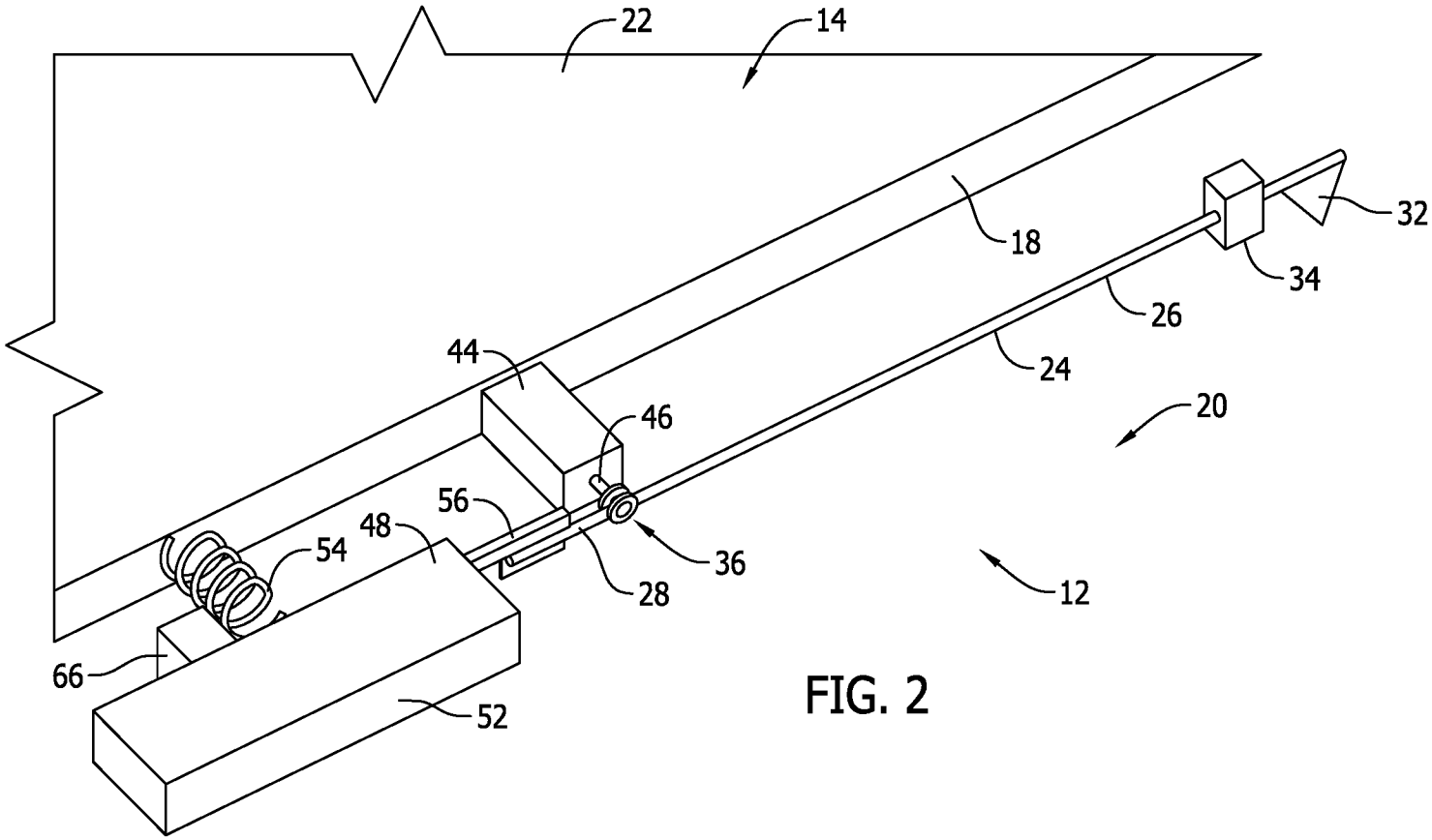
FIG. 2 is a representation of a perspective, close up view of the floor opening safety system of FIG. 1.

FIG. 1 is a representation of a perspective view of the floor opening safety system 12 of this disclosure. The safety system 12 is represented in FIG. 1 as being operatively connected to a first floor panel 14. The first floor panel 14 forms a part of a temporary floor grid or work platform decking that are assembled to provide a support surface for individuals working in an area of the floor grid or work platform decking. There is a second floor panel 16 that will be assembled adjacent the first floor panel 14 in the floor grid or work platform decking. The second floor panel 16 is represented in FIG. 4, with only a portion of the second floor panel 16 shown. Only a portion of the first floor panel 14 is represented in FIGS. 1-5. The first floor panel 14 has a rectangular configuration defined by a side edge surface 18 that extends around the first floor panel 14. As represented in FIG. 1, the side edge surface 18 is adjacent a floor opening 20. The floor opening is created by removing the second floor panel 16 from its position adjacent the first floor panel 14. The first floor panel 14 also has a top surface 22. The top surface 22 is oriented horizontally in use. The side edge surface 18 is oriented vertically in use. Although the first floor panel 14 is represented in FIG. 1 as having a general rectangular configuration, the floor opening safety system 12 of this disclosure is not limited to use with only floor panels having rectangular configurations, and could be employed with floor panels having various different configurations.

The floor opening safety system 12 is comprised of a flagpole 24. The flagpole 24 has a configuration of a narrow, elongate rod with a length dimension that extends between a distal end 26 of the flagpole and an opposite proximal end 28 of the flagpole. The flagpole 24 is constructed of a metal material that gives the flagpole sufficient rigidity to prevent the flagpole from bending when in its horizontal orientation relative to the first floor panel 14 as represented in FIG. 1. Other equivalent materials could be used in the construction of the flagpole 24. A signal flag 32 is on the distal end 26 of the flagpole 24. There is also a weight 34 on the distal end 26 of the flagpole 24, The weight 34 is used to move the flagpole to its horizontal orientation relative to the first floor panel 14 as represented in FIG. 1, as will be explained. The weight 34 may not be needed, as the weight of the distal end 26 of the flagpole 24 and the weight of the signal flag 32 may be sufficient to move the flagpole 24 to its horizontal orientation or to a first position of the flagpole 24 relative to the first floor panel 14 represented in FIG. 1.

There is a pivot connection 36 connecting the flagpole 24 to the first floor panel 14. More specifically, the pivot connection 36 connects the flagpole 24 to the side edge surface 18 of the first floor panel 14. The pivot connection 36 comprises a base 38 that extends outwardly from the side edge surface 18 of the first floor panel 14 over the area of the floor opening 20 adjacent the side edge surface 18 of the first floor panel 14. A pivot pin 46 protects horizontally from the pivot connection base 44 over the floor opening 20. The pivot connection pin 46 is connected to the flagpole 24 between the distal end 26 of the flagpole and the proximal end 28 of the flagpole. The pivot connection base 44 and the pivot connection pin 46 operatively connect the flagpole 24 to the first floor panel 14 over the floor opening 20 that has been created by the removal of the second floor panel 16 from over the floor opening 20. As represented in FIG. 1, a majority of the length dimension of the flagpole 24 makes up the distal end 26 of the flagpole on one side of the pivot connection 36, with the proximal end 28 of the flagpole being on the opposite side of the pivot connection 36.

The flagpole 24 is rotatable about the pivot connection 36 between a first position of the flagpole 24 relative to the first floor panel 14 where the flagpole 24 is oriented horizontally relative to the first floor panel 14, and a second position of the flagpole 24 relative to the first floor panel 14 where the flagpole is oriented vertically relative to the first floor panel 14 and the distal end 26 of the flagpole and the signal flag 32 are positioned above the top surface 22 of the first floor panel 14. When the flagpole 24 is rotated to the second position, the distal end 26 of the flagpole 24 and the signal flag 32 on the distal end 26 of the flagpole 24 provide a visual indication of the floor opening 20 adjacent the first floor panel 14.

A contact pad 48 is positioned in the floor opening 20 adjacent the first floor panel 14. The contact pad 48 represented in FIG. 1 has a general rectangular, block configuration. However, the contact pad 48 could have other equivalent configurations. The contact pad 48 has a side surface 52 that is configured to contact the second floor panel 16 when the second floor panel 16 is positioned over the floor opening 20 adjacent the first floor panel 14.

A spring 54 is operatively connected between the contact pad 48 and the first floor panel 14, and more specifically the side edge surface 18 of the first floor panel 14. The spring 54 represented in FIG. 1 is a linearly acting coil spring. However, other equivalent types of linear acting springs, for example a leaf spring may be employed instead of the coil spring 54. The spring 54 biases the contact pad 48 to move away from the first floor panel 14, and more specifically the side edge surface 18 of the first floor panel 14. The spring 54 biases the contact pad 48 to move away from the first floor panel 14 from a first position of the contact pad 48 relative to the first floor panel 14 where the contact pad 48 is adjacent the side edge surface 18 of the first floor panel 14, to a second position of the contact pad 48 relative to the first floor panel 14 where the contact pad 48 is spaced away from the side edge surface 18 of the first floor panel 14.

A drive lever 56 extends from the contact pad 48. The drive lever 56 is positioned in the floor opening 20 adjacent the proximal end 28 of the flagpole 24. The drive lever 56 is moveable with the contact pad 48 between a first position and a second position of the drive lever 56 relative to the first floor panel 14. In the first position of the drive lever 56 relative to the first floor panel 14 the drive lever 56 is spaced from the proximal end 28 of the flagpole 24, enabling the flagpole 24 to be rotated to the first position of the flagpole 24 relative to the first floor panel 14. In the second position of the drive lever 56 relative to the first floor panel 14, the drive lever 56 is in engagement with the proximal end 28 of the flagpole 24 and moves the flagpole 24 to, and holds the flagpole 24 in the second position of the flagpole 24 relative to the first floor panel 14. The drive lever 56 has a configuration where, as the drive lever 56 is moved from its first position relative to the first floor panel 14 toward the second position of the drive lever 56 relative to the first floor panel 14, the drive lever 56 will gradually engage with the proximal end 28 of the flagpole 24 and slide over the proximal end 28 of the flagpole 24. As the drive lever 56 continues to slide over the proximal end 28 of the flagpole 24, it will gradually push downwardly on the proximal end 28 of the flagpole 24. As the drive lever 56 is continued to be moved over the proximal end 28 of the flagpole 24, the drive lever 56 continues to push downwardly on the proximal end 28 of the flagpole 24 causing the proximal end 28 of the flagpole 24 to rotate counter-clockwise downwardly about the pivot connection 36. As the drive lever 56 is moved to its second position relative to the first floor panel 14, the drive lever 56 will continue to push downwardly on the proximal end 28 of the flagpole 24 until the proximal end 28 of the flagpole 24 is rotated counter-clockwise about the pivot connection 36 to a position where the proximal end 28 of the flagpole 24 is substantially oriented vertically relative to the top surface 22 of the first floor panel 14. This results in the distal end 26 of the flagpole 24 being rotated counter-clockwise upwardly until the distal end 28 of the flagpole 24 is substantially oriented vertically relative to the top surface 22 of the first floor panel 14.

When the second floor panel 16 is positioned over the floor opening 20 and is moved toward the first floor panel 14, the second floor panel 16 engages the contact pad 48 and moves the contact pad 48 from its second position relative to the first floor panel 14 toward its first position relative to the first floor panel 14. This movement of the contact pad 48 compresses the spring 54 and moves the drive lever 56 from its second position relative to the first floor panel 14 to its first position relative to the first floor panel 14. This causes the drive lever 56 to disengage from the proximal end 28 of the flagpole 24. With the drive lever 56 disengaged from the proximal end 28 of the flagpole 24, the weight of the distal end 26 of the flagpole 24 and the weight of the signal flag 32 (and the weight of the weight 34 if present) cause the flagpole 24 to be rotated in a clockwise direction as viewed in FIG. 1 about the pivot connection 36. This rotation is continued until the flagpole 24 is moved to the first position of the flagpole 24 relative to the first floor panel 14 where the flagpole 24 is positioned horizontally relative to the first floor panel 14.

Figure 3:
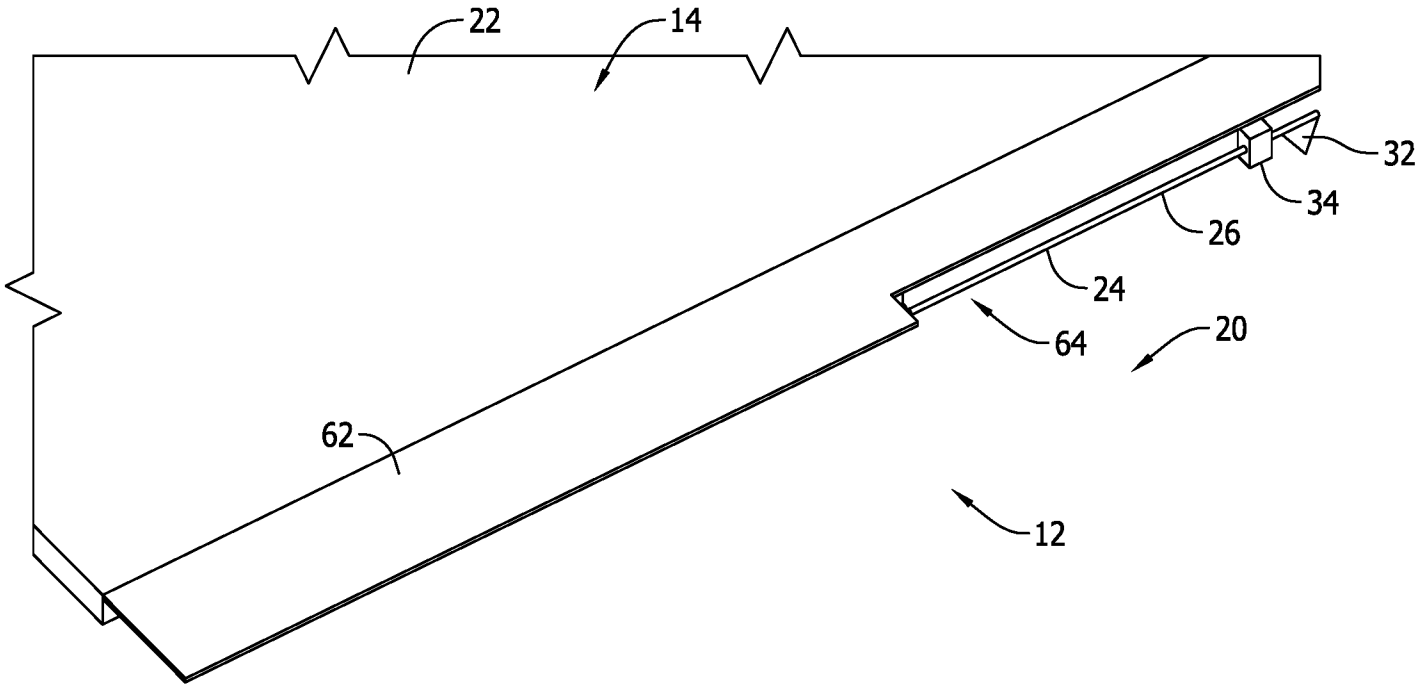
FIG. 3 is a representation of a perspective view of the floor opening safety system of FIG. 1, with a cover panel installed.
Figure 4:
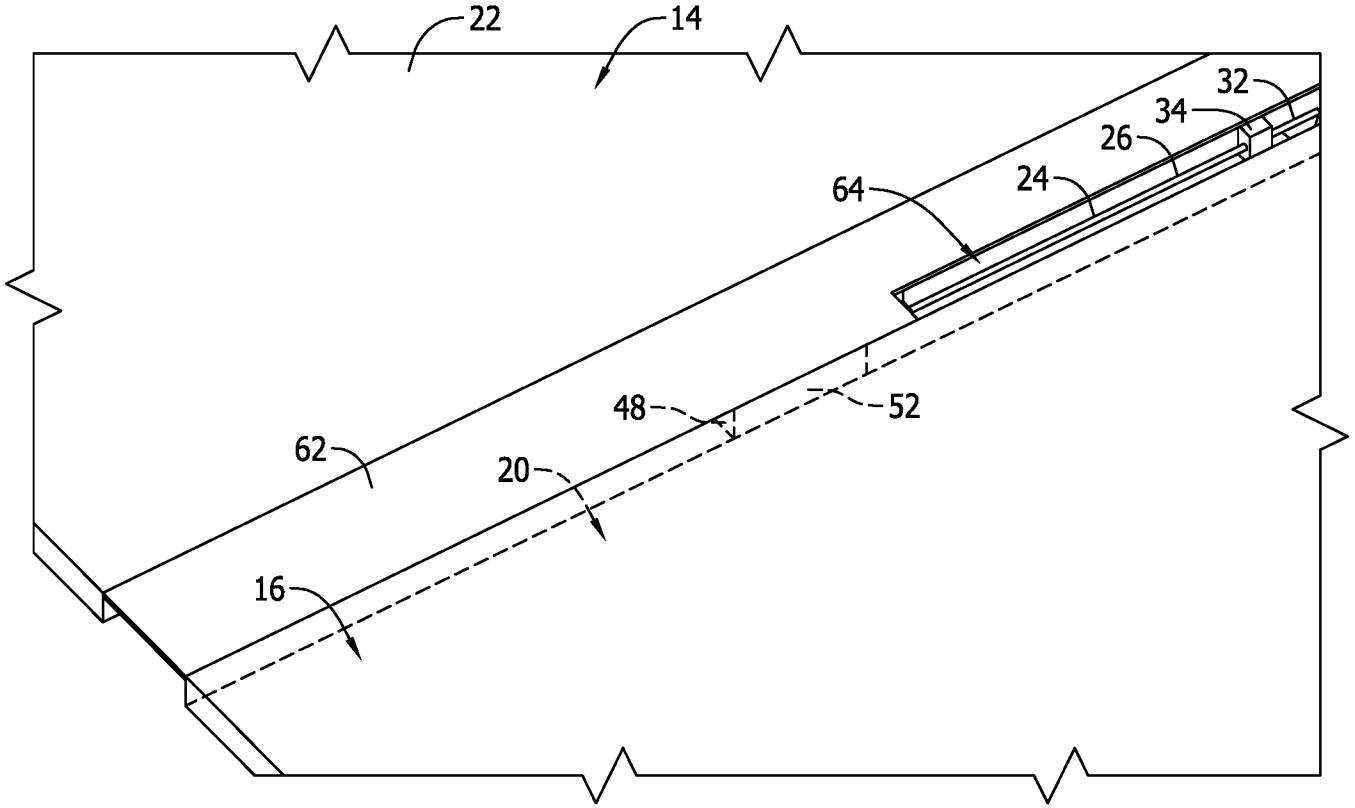
FIG. 4 is a representation of a perspective view of the floor opening safety system similar to FIG. 3, but with a second floor panel positioned adjacent the first floor panel.
Figure 5:
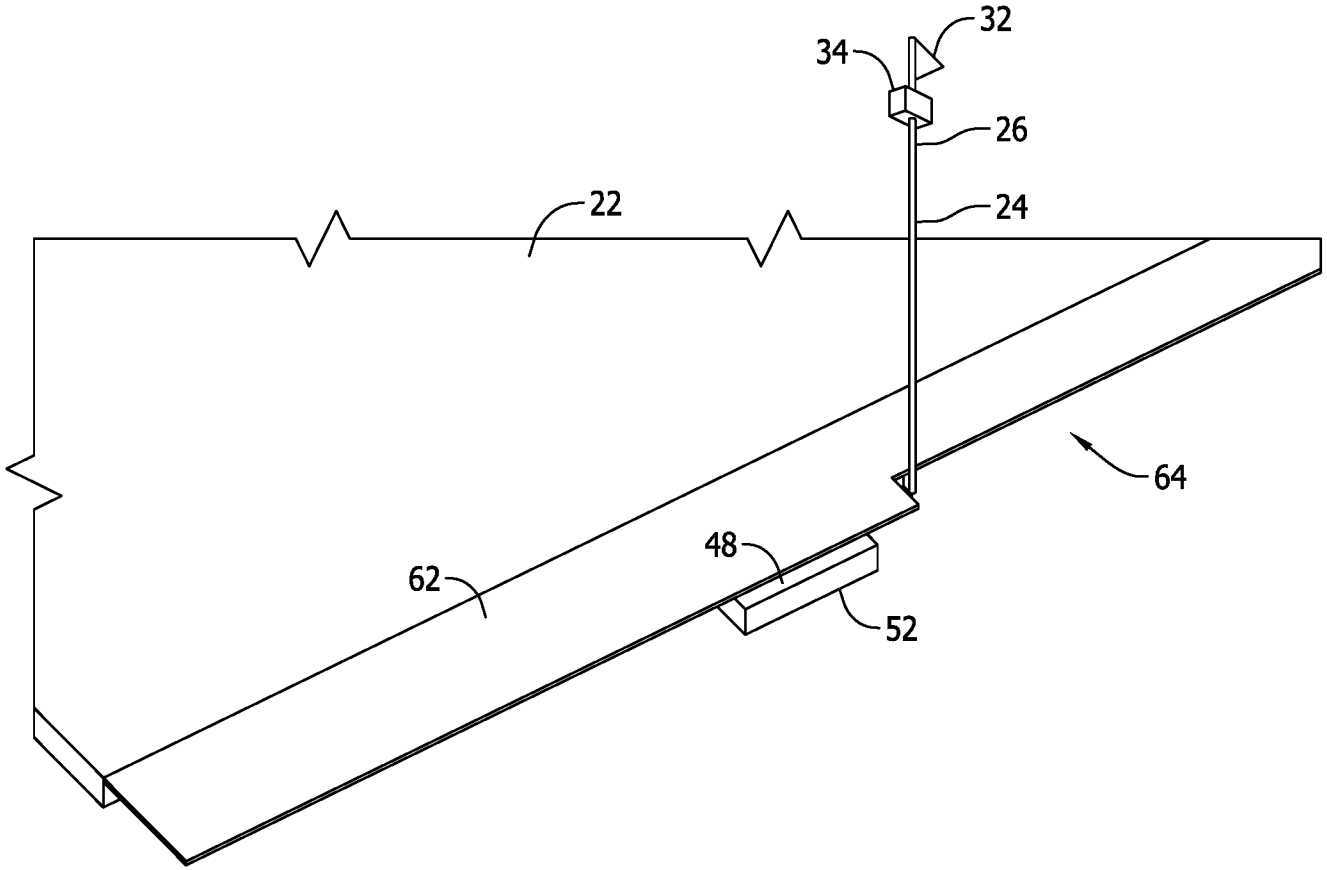
FIG. 5 is a representation of a perspective view of the floor opening safety system that has been activated to provide a visual indication of a floor opening adjacent the first floor panel.

A cover panel 62 represented in FIGS. 3-5 is connected to the first floor panel 14. The cover panel 62 extends from the first floor panel 14 over the floor opening 20. The cover panel 62 also extends over the contact pad 48, the spring 54 operatively connecting the contact pad 48 to the first floor panel 14, the drive lever 56 projecting from the contact pad 48 and the proximal end 28 of the flagpole 24. When the flagpole 24 is rotated clockwise about the pivot connection 36 to its first position relative to the first floor panel 14, the proximal end 28 of the flagpole 24 engages against the underside of the cover panel 62 and holds the flagpole 24 in its first position relative to the first floor panel 14.

There is an elongate notch 64 in the cover panel 62 on the opposite side of the cover panel from the first floor panel 14. The notch 64 in the cover panel 62 extends over the pivot connection 36 and the distal end 26 of the flagpole 24. The notch 64 provides clearance to the distal end 26 of the flagpole 24 to enable the distal end 26 of the flagpole 24 and the signal flag 32 to rotate upwardly in a counter clockwise direction about the pivot connection 36 and through the notch 64 to the second position of the flagpole 24 relative to the first floor panel 14.

When the second floor panel 16 is removed from its position adjacent the cover panel 62 and the first floor panel 14 exposing the floor opening 20, the spring 54 biasing the contact pad 48 away from the first floor panel 14 moves the contact pad 48 from its first position adjacent the first floor panel 14 to its second position spaced outwardly from the first floor panel 14. This movement of the contact pad 48 moves the drive lever 56 from its first position relative to the first floor panel 14 to its second position relative to its first floor panel 14 where the drive lever 56 engages against the proximal end 28 of the flagpole 24. As the contact pad 48 moves toward its second position relative to the first floor panel 14, the engagement of the drive lever 56 against the proximal end 28 of the flagpole 24 causes the drive lever 56 to slide over the proximal end 28 of the flagpole 24 and push the proximal end 28 of the flagpole 24 downwardly. This causes the proximal end 28 of the flagpole 24 to rotate in a counter-clockwise direction about the pivot connection 36 and causes the distal end 26 of the flagpole 24 to rotate in a counter-clockwise direction about the pivot connection 36 upwardly through the notch 64 to the second position of the flagpole 24 relative to the first floor panel 14. This positions the distal end 26 of the flagpole 24 and the signal flag 32 above the first floor panel 14 where the distal end 26 of the flagpole 24 and the signal flag 32 provide a visual indication of the floor opening 20 adjacent the cover panel 62 and the first floor panel 14.

An audio module 66 is operatively connected to the contact pad 48 and/or the spring 54. The audio module 66 is represented schematically in FIGS. 1 and 2. The audio module 66 is operable to emit a sound signal in response to the contact pad 48 moving from the first position of the contact pad 48 relative to the first floor panel 14 to the second position of the contact pad 48 relative to the first floor panel 14, Thus, when the second floor panel 16 is removed from over the floor opening 20, the audio module is operated to emit a sound signal that warns individuals in the area of the first floor panel 14 of the floor opening 20 adjacent the first floor panel 14. When the second floor panel 16 is positioned over the floor opening 20 and moved toward the first floor panel 14, the second floor panel 16 engages against the contact pad 48 and moves the contact pad toward its first position relative to the first floor panel 14, compressing the spring 54. This movement of the contact pad 48 and/or the spring 54 operates the audio module 66 to not emit the sound signal in response to the contact pad 48 being in the first position of the contact pad 48 relative to the first floor panel 14.

As various modifications could be made in the construction of the floor opening safety system and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. A floor opening safety system comprising:

a contact pad positioned in a floor opening adjacent a first floor panel, the contact pad being configured to contact a second floor panel positioned over the floor opening adjacent the first floor panel;

a flagpole operatively connected by a pivot connection to the first floor panel, the flagpole having a distal end and a proximal end, the flagpole being rotatable about the pivot connection between a first position of the flagpole in which the flagpole is oriented horizontally relative to the first floor panel and a second position of the flagpole in which the flagpole is oriented vertically relative to the first floor panel and the distal end of the flagpole is positioned above the first floor panel where the distal end of the flagpole provides a visual indication of the floor opening adjacent the first floor panel;

the flagpole being rotated about the pivot connection to the first position of the flagpole oriented horizontally relative to the first floor panel in response to the second floor panel being positioned over the floor opening and engaging with the contact pad; and, the flagpole being rotated about the pivot connection to the second position of the flagpole in response to the second floor panel being removed from over the floor opening and disengaging from the contact pad.

2. The floor opening safety system of claim 1, further comprising:

a spring operatively connected between the contact pad and the first floor panel, the spring biasing the contact pad to move away from the first floor panel from a first position of the contact pad adjacent the first floor panel to a second position of the contact pad spaced away from the first floor panel;

the flagpole being rotated about the pivot connection to the second position of the flagpole relative to the first floor panel in response to the second floor panel being removed from the floor opening and disengaging from the contact pad enabling the spring to decompress and move the contact pad to the second position of the contact pad away from the first floor panel and operatively engage with the proximal end of the flagpole.

3. The floor opening safety system of claim 2, further comprising:

a cover panel connected to the first floor panel, the cover panel extending from the first floor panel over the floor opening, over the proximal end of the flagpole and over the contact pad.

4. The floor opening safety system of claim 3, further comprising:

the cover panel having a notch in the cover panel on an opposite side of the cover panel from the first floor panel, the notch in the cover panel extending over the pivot connection and the distal end of the flagpole.

5. The floor opening safety system of claim 1, further comprising:

a spring operatively connected between the contact pad and the first floor panel, the spring biasing the contact pad to move away from the first floor panel from a first position of the contact pad adjacent the first floor panel to a second position of the contact pad spaced away from the first floor panel;

the contact pad moving to the first position of the contact pad relative to the first floor panel compressing the spring in response to the second floor panel being positioned over the floor opening and engaging with the contact pad; and, the spring biasing the contact pad to move away from the first floor panel and operatively engage with the proximal end of the flagpole pushing the proximal end of the flagpole to rotate downwardly causing the distal end of the flagpole to rotate upwardly to the second position of the flagpole relative to the first floor panel in response to the second floor panel being removed from over the floor opening and disengaging from the contact pad.

6. The floor opening safety system of claim 5, further comprising:

an audio module operatively connected to the contact pad, the audio module being operable to emit a sound signal in response to the contact pad being in the second position of the contact pad relative to the first floor panel and the audio module being operable to not emit the sound signal in response to the contact pad being in the first position of the contact pad relative to the first floor panel.

7. The floor opening safety system of claim 1, further comprising:

a signal flag on the distal end of the flagpole.

8. A floor opening safety system comprising:

a flagpole, the flagpole having a length dimension between a distal end of the flagpole and a proximal end of the flagpole;

a pivot connection on the flagpole, the pivot connection being operatively connected to a first floor panel that is adjacent a floor opening with the pivot connection positioning the flagpole in the floor opening, the pivot connection being operable to enable the flagpole to pivot about the pivot connection between a first position of the flagpole relative to the first floor panel where the flagpole is oriented horizontally relative to the first floor panel and a second position of the flagpole relative to the first floor panel where the flagpole is oriented vertically relative to the first floor panel; and, a drive lever adjacent the proximal end of the flagpole, the drive lever being moveable between first and second positions of the drive lever relative to the first floor panel where in the first position of the drive lever relative to the first floor panel the drive lever is spaced from the proximal end of the flagpole enabling the flagpole to be in the first position of the flagpole relative to the first floor panel, and in the second position of the drive lever relative to the first floor panel the drive lever is in engagement with the proximal end of the flagpole and holds the flagpole in the second position of the flagpole relative to the first floor panel.

9. The floor opening safety system of claim 8, further comprising:

a spring operatively connected to the drive lever, the spring biasing the drive lever from the first position of the drive lever relative to the first floor panel to the second position of the drive lever relative to the first floor panel.

10. The floor opening safety system of claim 9, further comprising:

the spring being operatively connected to the first floor panel with the spring positioning the drive lever in the floor opening.

11. The floor opening safety system of claim 10, further comprising:

a contact pad connected to the drive lever and the spring; and, the spring positioning the contact pad in the floor opening where, when a second floor panel is positioned in the floor opening, the second floor panel engages with the contact pad and moves the contact pad toward the first floor panel compressing the spring, and moves the drive lever to the first position of the drive lever relative to the first floor panel disengaging the drive lever from the proximal end of the flagpole and causing the flagpole to rotate to the first position of the flagpole relative to the first floor panel.

12. The floor opening safety system of claim 11, further comprising:

when the second floor panel is removed from the floor opening the second floor panel disengages from the contact pad and enables the spring to decompress and bias the drive lever from the first position of the drive lever relative to the first floor panel to the second position of the drive lever relative to the first floor panel where the drive lever engages with the proximal end of the flagpole and rotates the flagpole to the second position of the flagpole relative to the first floor panel.

13. The floor opening safety system of claim 8, further comprising:

a cover panel connected to the first floor panel, the cover panel extending from the first floor panel over the floor opening, over the proximal end of the flagpole and over the drive lever.

14. The floor opening safety system of claim 13, further comprising:

a notch in the cover panel, the notch in the cover panel extending over the pivot connection and over the distal end of the flagpole.

15. The floor opening safety system of claim 8, further comprising:

an audio module operatively connected to the drive lever, the audio module being operable to emit a sound signal in response to the drive lever being in the second position of the drive lever relative to the first floor panel and the audio module being operable to not emit the sound signal in response to the drive lever being in the first position of the drive lever relative to the first floor panel.

16. The floor opening safety system of claim 8, further comprising:

a signal flag on the distal end of the flagpole.

17. A method of signaling a floor opening, the method comprising:

connecting a flagpole by a pivot connection to a first floor panel adjacent a floor opening, the flagpole having a distal end and a proximal end, the pivot connection being operable to enable the flagpole to pivot about the pivot connection between a first position of the flagpole in which the flagpole is oriented horizontally relative to the first floor panel and a second position of the flagpole in which the flagpole is oriented vertically relative to the first floor panel; and, operatively connecting a drive lever to the first floor panel adjacent the proximal end of the flagpole, the drive lever being moveable between a first position of the drive lever relative to the first floor panel where the drive lever is spaced from the proximal end of the flagpole enabling the flagpole to move to the first position of the flagpole oriented horizontally relative to the first floor panel, and a second position of the drive lever relative to the first floor panel where the drive lever engages with the proximal end of the flagpole and holds the flagpole in the second position of the flagpole relative to the first floor panel.

18. The method of claim 17, further comprising:

moving the drive lever from the first position of the drive lever relative to the first floor panel to the second position of the drive lever relative to the first floor panel by a spring operatively connected between the first floor panel and the drive lever.

19. The method of claim 18, further comprising:

moving the drive lever from the second position of the drive lever relative to the first floor panel to the first position of the drive lever relative to the first floor panel by positioning a second floor panel over the floor opening and operatively engaging the drive lever with the second floor panel and moving the drive lever from the second position of the drive lever relative to the first floor panel to the first position of the drive lever relative to the first floor panel compressing the spring.

20. The method of claim 19, further comprising:

operatively connecting an audio module to the drive lever and controlling operation of the audio module to emit a sound signal in response to the drive lever being in the second position of the drive lever relative to the first floor panel and controlling operation of the audio module to not emit the sound signal in response to the drive lever being in the first position of the drive lever relative to the first floor panel.

* * * * *